US007113068B2

(12) United States Patent
Chou

(10) Patent No.: US 7,113,068 B2
(45) Date of Patent: Sep. 26, 2006

(54) WINDING STRUCTURE OF INDUCTOR USED IN POWER FACTOR CORRECTION CIRCUIT

(76) Inventor: Chin-Kuo Chou, No. 3.1, Shien Pan Rd., Kuei San Industrial Zone, Taoyuan Shien (TW)

( * ) Notice: Subject to any disclaimer, the term of this patent is extended or adjusted under 35 U.S.C. 154(b) by 0 days.

(21) Appl. No.: 10/020,670

(22) Filed: Dec. 12, 2001

(65) Prior Publication Data

US 2003/0006874 A1 Jan. 9, 2003

(30) Foreign Application Priority Data

Jul. 6, 2001 (TW) ..... 90211431 U

(51) Int. Cl.
*H01F 27/30* (2006.01)

(52) U.S. Cl. ..... 336/206; 336/150; 336/192

(58) Field of Classification Search ..... 336/65, 336/150, 192, 205–207, 209, 229; 333/255

See application file for complete search history.

(56) References Cited

U.S. PATENT DOCUMENTS

| | | | | | |
|---|---|---|---|---|---|
| 3,149,296 | A | * | 9/1964 | Cox | 336/84 R |
| 3,243,750 | A | * | 3/1966 | Collins | 336/150 |
| 3,675,176 | A | * | 7/1972 | Brown | 336/182 |
| 3,914,680 | A | * | 10/1975 | Hesler et al. | 363/97 |
| 4,002,999 | A | * | 1/1977 | Hesler et al. | 331/113 A |
| RE33,345 | E | * | 9/1990 | Sylvester et al. | 336/180 |
| 6,492,893 | B1 | * | 12/2002 | De Graaf | 336/229 |

* cited by examiner

*Primary Examiner*—Tuyen T. Nguyen
(74) *Attorney, Agent, or Firm*—Myers Dawes Andras & Sherman LLP

(57) ABSTRACT

A winding structure of an inductor used in a power factor correction circuit is provided. The winding structure includes a ring-shaped core with a gap, a first coil and a second coil wound around the core. The negative end of the first coil and the positive end of the second coil is coupled to form a central tap.

4 Claims, 4 Drawing Sheets

WINDING STRUCTURE OF INDUCTOR USED IN POWER FACTOR CORRECTION CIRCUIT

FIELD OF THE INVENTION

The present invention relates to a winding structure, and more particularly to a winding structure of an inductor used in a power factor correction circuit.

BACKGROUND OF THE INVENTION

Typically, a commercial AC power supply is rectified, filtered and converted into DC power source for many electronic products. Although the input AC voltage is sinusoidal, the waveform of the input current is pulse due to the operation of rectifier diodes and a filtering capacitor. The input current (also referred as a harmonic current) relative to the power consumption represented by a power factor is reduced. The reduced power factor indicates that energy resource of the earth has been wasted. Under such circumstances, some regulations about power factor and harmonic current have been provided, such as IEC-1000-3-2 by IEC (International Electrochemical Commission).

The typical means for improving harmonic current includes an active type power factor correction circuit and an inductor power factor correction circuit. Since the circuit layout is simple and cost-effective, the inductor power factor correction circuit is widely used. Because the inductor power factor correction circuit is implemented under a low frequency and high current, the typical inductor is formed by using an EI type core wound around coils. Such inductor has disadvantages of high inductance leakage and high volume.

Therefore, the present invention provides an improved winding structure of an inductor used in an inductor power factor correction circuit so as to overcome the problems described above.

SUMMARY OF THE INVENTION

It is an object of the present invention to provide a winding structure of an inductor used in a power factor correction circuit, which meets the requirement of IEC-1000-3-2.

It is another object of the present invention to provide a winding structure of an inductor used in a power factor correction circuit for reducing the volume and weight.

In accordance with one aspect of the present invention, there is provided a winding structure of an inductor used in a power factor correction circuit. The winding structure includes a ring-shaped core with a gap, a first coil and a second coil wound around the core. The negative end of the first coil and the positive end of the second coil is coupled to form a central tap.

Preferably, the core is further covered with an insulating layer.

Preferably, the insulating layer is made of polyvinyl chloride (PVC).

Preferably, each of the first coil and the second coil is made double by winding two parallel winding conductors around the core.

Preferably, the core is further wrapped by an adhesive tape.

In accordance with one aspect of the present invention, there is provided an apparatus for fastening a winding structure of an inductor, wherein the winding structure includes a ring-shaped core wound around a first coil and a second coil. The apparatus includes an upper bracket and a lower bracket. The upper bracket has a first plate with a first opening in the center and a first sleeve extending downwards. The lower bracket has a second plate with a second opening in the center and a second sleeve extending upwards, wherein the first sleeve are in contact with the second sleeve and inserted into the interior space of the winding structure.

Preferably, the upper bracket and the lower bracket are connected by coupling a screw with a nut.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
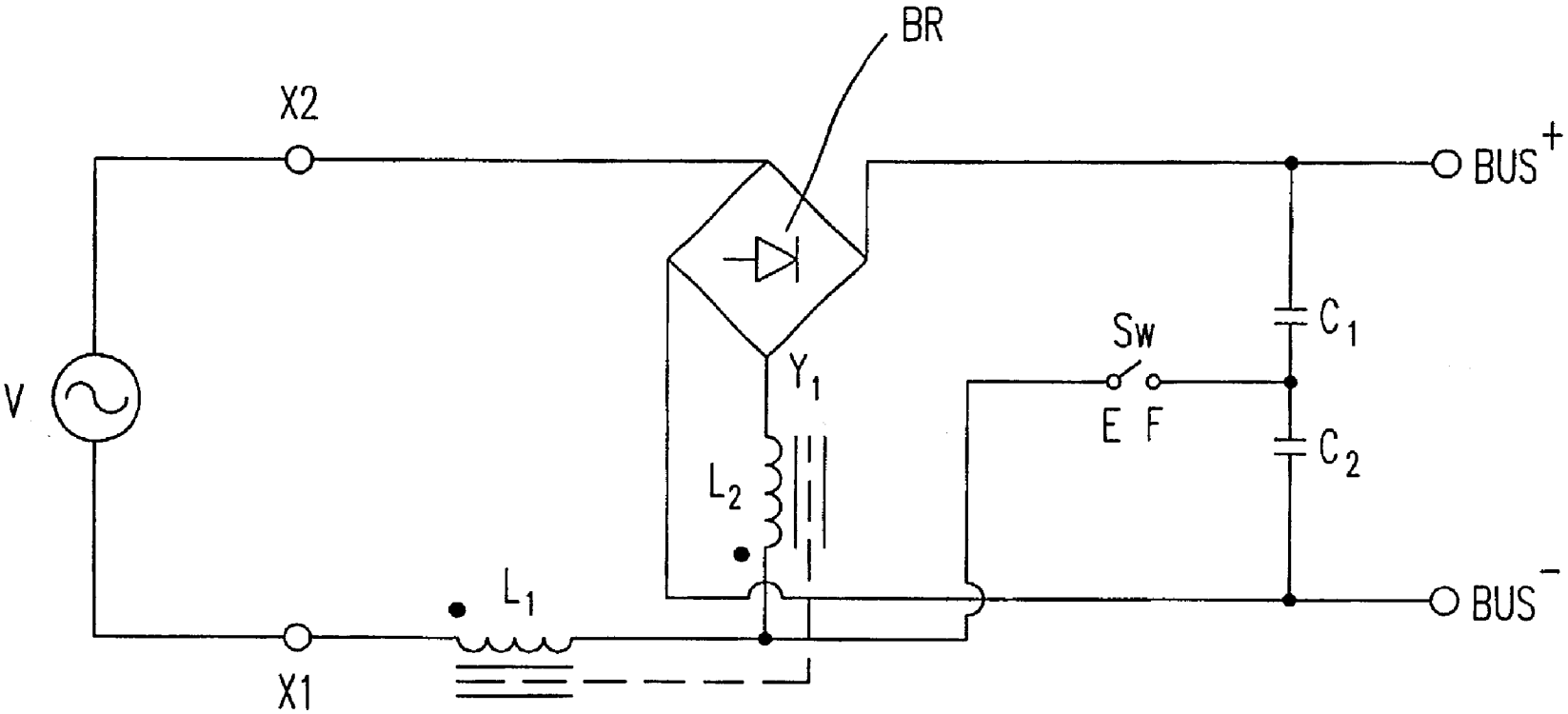
FIG. 1 is a simplified diagram illustrating an inductor type power factor correction circuit applied in the present invention.
Figure 2A:
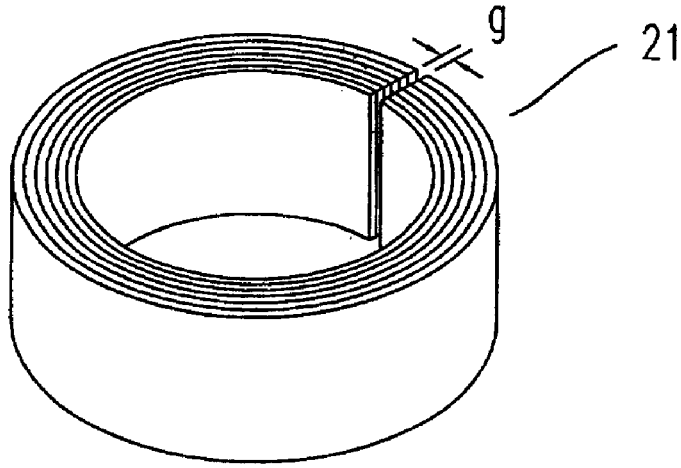
FIGS. 2(*a*) to 2(*d*) are views illustrating the steps of assembling the winding structure of an inductor according to a preferred embodiment of the present invention.
Figure 2B:
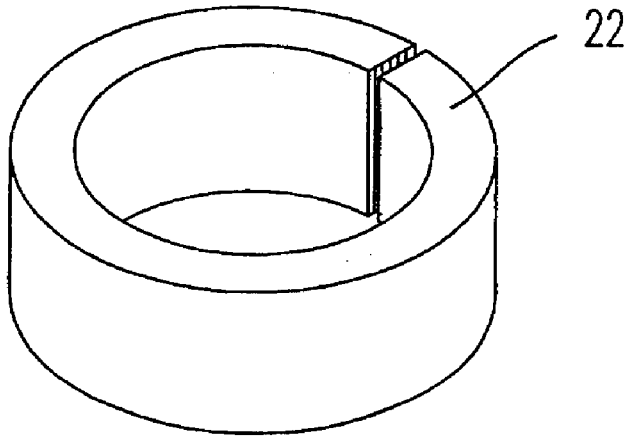
Figure 2C:
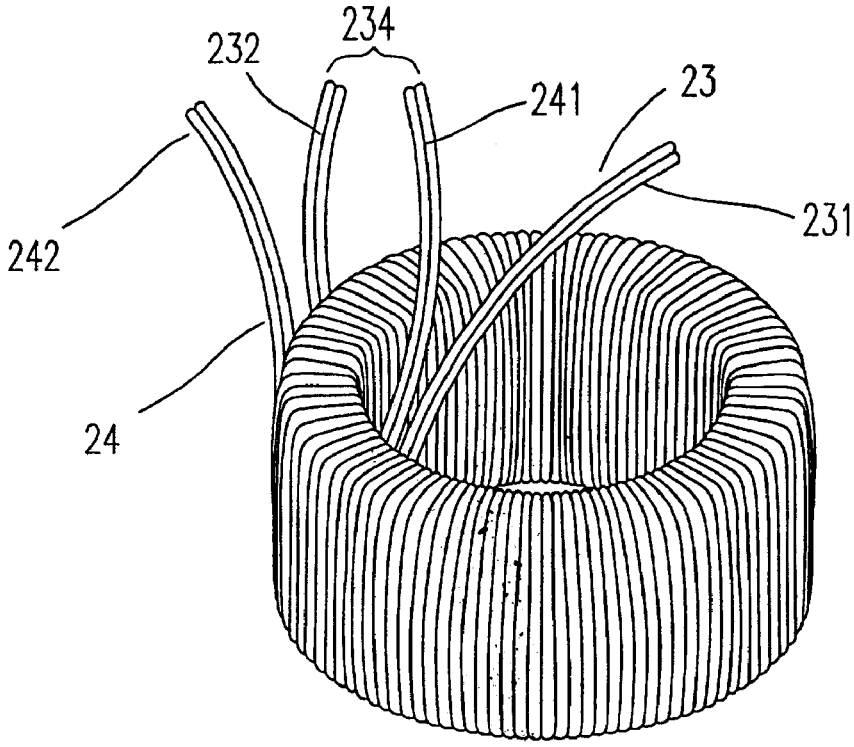
Figure 2D:
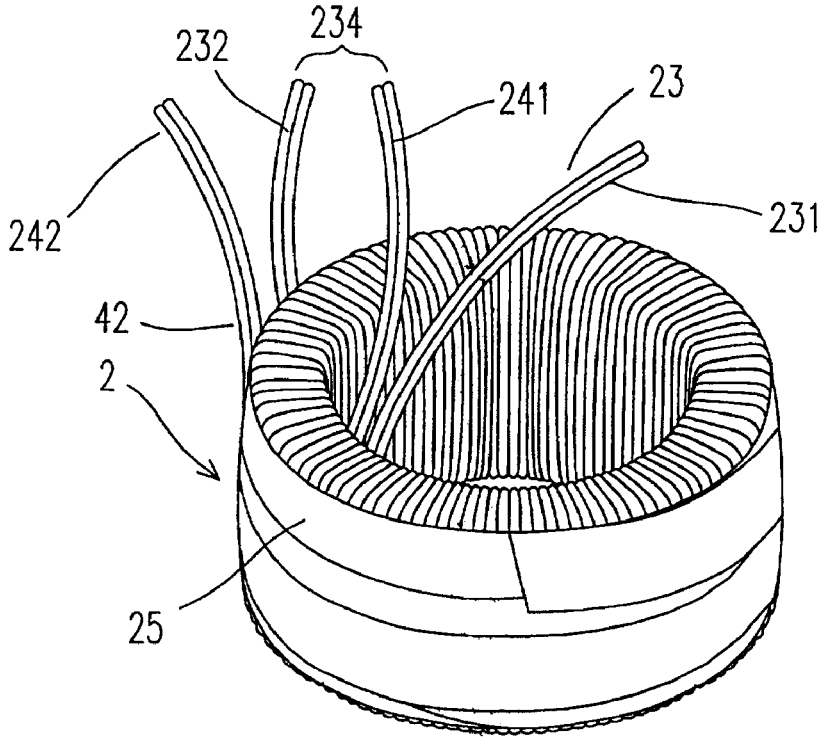

FIG. 1 is a simplified diagram illustrating an inductor type power factor correction circuit applied in the present invention. The input terminals X1 and X2 of the alternating voltage V are respectively connected with a first inductor L1 and a bridge rectifier circuit BR. The negative end of the first inductor L1 is connected to the positive end of a second inductor L2 and a switch device Sw. The negative end of the second inductor L2 is connected with the bridge rectifier circuit BR. The output terminals of the bridge rectifier circuit BR are connected to the buses $BUS^+$ and $BUS^-$, which will further connected with a switching circuit (not shown). The operation principle of the switching circuit is well known to a person skilled in the art. A first capacitor C1 and a second capacitor C2 in series are connected to the buses $BUS^+$ and $BUS^-$. The switch device Sw has a point E connected to a tap of the first inductor L1 and the second inductor L2, and a point F connected to the first capacitor C1 and the second capacitor C2.

It is found the above-mentioned inductor type power factor correction circuit can meet the requirement of IEC-1000-3-2 standard. Furthermore, such circuit has an advantage of optionally adjusting the output voltage by the switch device Sw. For example, if the input voltage is 220 V, the output voltage is about 220 V when the switch device Sw is not conducted, or the output voltage is about 110 V when the switch device Sw is conducted.

The concept of the present invention is to provide a winding structure of a inductor in combination of the first inductor L1 and the second inductor L2 by winding a first coil and a second coil around a ring-shaped core, wherein the negative end of the first coil and the positive end of the second coil are coupled to form a central tap.

FIGS. 2(*a*) to 2(*d*) are views illustrating the steps of assembling the winding structure of an inductor according to a preferred embodiment of the present invention. In FIG. 2(*a*), there is provided a ring-shaped core 21 with a gap g. The gap g can increase current inductor. In FIG. 2(*b*), the core 21 is further covered with an insulating layer 22, which is preferably made of polyvinyl chloride (PVC). FIG. 2(*c*) shows that a first coil 23 and a second coil 24 are wound around the core 21. In this embodiment, each of the first coil 23 and the second coil 24 is made double by winding two parallel winding conductors around the core 21. The negative end 232 of the first coil 23 and the positive end 241 of the second coil 24 will be coupled to form a central tap 234. The positive end 231 of the first coil 23 and the negative end 242 of the second coil 24 will be respectively connected to the input terminal X1 of the alternating voltage V and the input terminal Y1 of the bridge rectifier circuit BR in accordance with the circuit in FIG. 1. In FIG. 2(*d*), the core 21 wound around the first coil 23 and the second coil 24 are then wrapped by an adhesive tape 25 so as to finish the winding structure 2 of the inductor according to the present invention.

Figure 3:
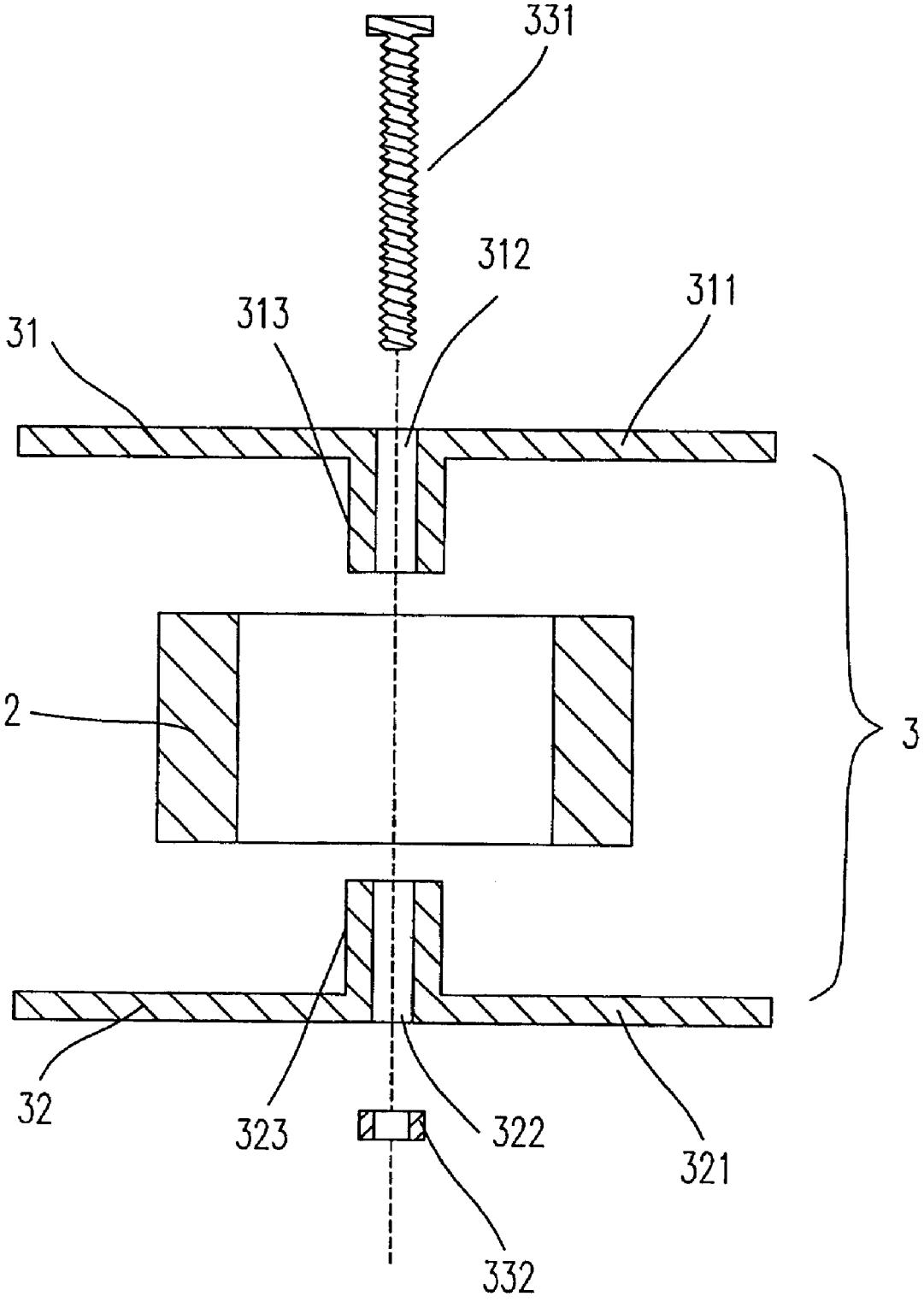
FIG. 3 is a view illustrating an apparatus for fastening the winding structure according to the present invention.

FIG. 3 is a view illustrating an apparatus for fastening the winding structure 2 according to the present invention. The fastening apparatus 3 includes an upper bracket 31 and a lower bracket 32. The upper bracket 31 includes a first plate 311 with a first opening 312 in the center and a first sleeve 313 extending downwards. The lower bracket 32 includes a second plate 321 with a second opening 322 in the center and a second sleeve 323 extending upwards. The process for fastening the winding structure 2 includes steps of (a) disposing the winding structure 2 on the lower bracket 32 wherein the second sleeve 323 is inserted into the interior space of the winding structure 2, allowing the first sleeve 313 in contact with the second sleeve 323 (i.e. the first sleeve 313 is also inserted into the interior space of the winding structure 2), and connecting the upper bracket 31 and the lower bracket 32 via the assembly of a screw 331 and nut 332.

It is found that the winding structure of an inductor according to the present invention can be applied in an inductor power factor correction circuit and meet the requirement of IEC-1000-3-2. It is also found that the volume or the weight of the winding structure in accordance with the present invention is merely 30% (based on a power of 300 W) when comparing with the traditional EI core winding structure.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A winding structure of an inductor used in a power factor correction circuit, comprising:

a ring-shaped core with a gap; and a first coil and a second coil wound around said core, wherein the negative end of said first coil and the positive end of said second coil is coupled to form a central tap; and an adhesive tape wrapped around an outer surface of said core after said first coil and said second coil are wound around said core, wherein said adhesive tape is directly adhered on said first coil and said second coil wound around said core.

2. The winding structure according to claim 1 wherein said core is further covered with an insulating layer.

3. The winding structure according to claim 2 wherein said insulating layer is made of polyvinyl chloride (PVC).

4. The winding structure according to claim 1 wherein each of said first coil and said second coil is made double by winding two parallel winding conductors around said core.

* * * * *